US008068635B2

(12) United States Patent
Carlson et al.

(10) Patent No.: US 8,068,635 B2
(45) Date of Patent: Nov. 29, 2011

(54) DIAPHRAGM WITH INTEGRATED ACOUSTICAL AND OPTICAL PROPERTIES

(75) Inventors: Jason L. Carlson, Sudbury, MA (US); Stefan Bokaemper, Boston, MA (US)

(73) Assignee: Emo Labs, Inc., Waltham, MA (US)

( * ) Notice: Subject to any disclaimer, the term of this patent is extended or adjusted under 35 U.S.C. 154(b) by 367 days.

(21) Appl. No.: 12/468,749

(22) Filed: May 19, 2009

(65) Prior Publication Data

US 2009/0285431 A1 Nov. 19, 2009

Related U.S. Application Data

(60) Provisional application No. 61/054,299, filed on May 19, 2008.

(51) Int. Cl.
*H04R 11/02* (2006.01)

(52) U.S. Cl. ..... 381/426; 381/423

(58) Field of Classification Search ..... 381/423, 381/426

See application file for complete search history.

(56) References Cited

U.S. PATENT DOCUMENTS

| | | | | |
|---|---|---|---|---|
| 4,352,961 | A * | 10/1982 | Kumada et al. | 455/350 |
| 4,503,564 | A * | 3/1985 | Edelman et al. | 398/132 |
| 5,965,249 | A | 10/1999 | Sutton et al. | |
| 6,023,123 | A * | 2/2000 | Petiet | 310/322 |
| 6,427,017 | B1 * | 7/2002 | Toki | 381/190 |
| 6,522,760 | B2 * | 2/2003 | Azima et al. | 381/152 |
| 6,708,797 | B2 * | 3/2004 | Long et al. | 181/149 |
| 6,720,708 | B2 * | 4/2004 | Athanas | 310/324 |
| 6,785,393 | B2 * | 8/2004 | Lipponen et al. | 381/191 |
| 7,010,143 | B2 * | 3/2006 | Kam | 381/426 |
| 7,020,302 | B2 * | 3/2006 | Konishi et al. | 381/424 |
| 7,038,356 | B2 * | 5/2006 | Athanas | 310/324 |
| 7,039,206 | B2 * | 5/2006 | Mellow | 381/190 |
| 7,050,600 | B2 * | 5/2006 | Saiki et al. | 381/388 |
| 7,120,263 | B2 * | 10/2006 | Azima et al. | 381/152 |
| 7,151,837 | B2 * | 12/2006 | Bank et al. | 381/190 |
| 7,174,025 | B2 * | 2/2007 | Azima et al. | 381/152 |
| 7,194,098 | B2 * | 3/2007 | Azima et al. | 381/152 |
| 7,212,648 | B2 * | 5/2007 | Saiki et al. | 381/423 |
| 7,236,602 | B2 * | 6/2007 | Gustavsson | 381/152 |
| 7,274,855 | B2 * | 9/2007 | Nevo et al. | 385/147 |
| 7,339,736 | B2 | 3/2008 | Trapani et al. | |
| 7,536,211 | B2 * | 5/2009 | Saiki et al. | 455/575.1 |
| 7,565,949 | B2 * | 7/2009 | Tojo | 181/199 |
| 7,583,811 | B2 * | 9/2009 | Wada | 381/388 |
| 7,792,319 | B2 * | 9/2010 | Kimura et al. | 381/431 |

(Continued)

OTHER PUBLICATIONS

The Physics Classroom, "Light Waves and Color—Lesson 1, How do we know light behaves as a wave?" available at http://www.physicsclassroom.com/Class/light/U12L1a.cfm, retrieved on Dec. 3, 2009.

(Continued)

*Primary Examiner* — David S. Warren

(74) *Attorney, Agent, or Firm* — Thomas C. Meyers; Adam M. Schoen; Brown Rudnick LLP

(57) ABSTRACT

A multifunctional transducer diaphragm may be configured as audio speaker system for displays wherein the multifunctional transducer diaphragm is capable of polarizing light transmitted therethrough and can convert mechanical motion into acoustical energy. In a related embodiment, a display panel system may comprise a multifunctional display screen comprising a single multifunctional transducer diaphragm capable of polarizing light which converts mechanical motion into acoustical energy, simultaneously providing both display screen and audio speaker functionalities.

21 Claims, 6 Drawing Sheets

U.S. PATENT DOCUMENTS

| | | | | |
|---|---|---|---|---|
| 7,884,529 | B2 * | 2/2011 | Johnson et al. | 310/324 |
| 7,903,091 | B2 * | 3/2011 | Lee et al. | 345/173 |
| 2001/0026626 | A1 * | 10/2001 | Athanas | 381/190 |
| 2002/0153194 | A1 | 10/2002 | Pocock et al. | |
| 2004/0037441 | A1 * | 2/2004 | Konishi et al. | 381/190 |
| 2004/0228501 | A1 * | 11/2004 | Saiki et al. | 381/423 |
| 2005/0180592 | A1 * | 8/2005 | Miura | 381/401 |
| 2006/0066803 | A1 * | 3/2006 | Aylward et al. | 349/158 |
| 2007/0243364 | A1 * | 10/2007 | Maekawa et al. | 428/220 |
| 2007/0260019 | A1 * | 11/2007 | Ohme et al. | 525/400 |
| 2008/0007829 | A1 | 1/2008 | Mizushima et al. | |
| 2009/0136690 | A1 * | 5/2009 | Sasada | 428/1.31 |
| 2009/0285431 | A1 * | 11/2009 | Carlson et al. | 381/345 |
| 2010/0224437 | A1 * | 9/2010 | Booth et al. | 181/166 |
| 2011/0033074 | A1 * | 2/2011 | Chang et al. | 381/333 |

OTHER PUBLICATIONS

Edmund Optics Worldwide, "Techspec Linear Polarizing Laminated Film," available at http://www.edmundoptics.com/onlinecatalog/displayproduct.cfm?productID=1912, retrieved on Dec. 3, 2009.

International Search Report and Written Opinion dated Nov. 13, 2009 issued in related International Patent Application No. PCT/US09/44544.

* cited by examiner

DIAPHRAGM WITH INTEGRATED ACOUSTICAL AND OPTICAL PROPERTIES

CROSS REFERENCE TO RELATED APPLICATIONS

This application claims the benefit of U.S. Provisional Application No. 61/054,299, filed May 19, 2008, the teachings of which are incorporated by reference.

TECHNICAL FIELD

The present disclosure relates to transducers that convert mechanical energy into acoustical energy for the purpose of generating sound, and in one particular form, to a flat film speaker with a transparent diaphragm compatible with a video display or otherwise integrated into a display screen.

BACKGROUND INFORMATION

Mechanical-to-acoustical transducers may have an actuator that may be coupled to an edge of a speaker membrane or diaphragm that may then be anchored and spaced from the actuator. Such a system may provide a diaphragm-type speaker where a video display may be viewed through the speaker. The actuators may be electromechanical, such as electromagnetic, piezoelectric or electrostatic. Piezo actuators do not create a magnetic field that may then interfere with a display image and may also be well suited to transform the high efficiency short linear travel of the piezo motor into a high excursion, piston-equivalent diaphragm movement.

One example of mechanical-to-acoustical transducer including an actuator that may be coupled to an edge of a diaphragm material is recited in U.S. Pat. Nos. 6,720,708 and 7,038,356 whose teachings are incorporated herein by reference in their entirety. The use of a support and actuator that was configured to be responsive to what was identified as surrounding conditions of, e.g., heat and/or humidity, is described in U.S. Publication No. 2006/0269087.

SUMMARY

In one exemplary embodiment, the present disclosure relates to a diaphragm for use with a mechanical-to-acoustical transducer, comprising a layer of optically clear film having a haze value of less than or equal to 30% and a total luminous transmittance of equal to or greater than 75%. The diaphragm may also include a layer of polarizing film capable of polarizing light therethrough exhibiting a crossed transmittance of less than 20%. The diaphragm is capable of converting mechanical motion into acoustical energy, wherein the diaphragm has a thickness of 100 microns to 2.0 mm, a Young's Modulus in the range of 1 GPa to 80 GPa, and the polarizing film has a total luminous transmittance of greater than or equal to 35%.

In a second exemplary embodiment the present disclosure relates to an acoustic transducer that converts a mechanical motion into acoustical energy, said acoustic transducer comprising a diaphragm comprising a layer of optically clear film having a haze value of less than or equal to 30% and a total luminous transmittance of equal to or greater than 75% and a layer of polarizing film capable of polarizing light therethrough and characterized by exhibiting a crossed transmittance of less than 20% and is capable of converting mechanical energy into acoustical energy wherein said diaphragm has a thickness of 100 microns to 2.0 mm, a Young's Modulus in the range of 1 GPa to 80 GPa and said polarizing film has a total luminous transmittance of greater than or equal to 35%.

These and other features and objects of this invention will be more readily understood from the following detailed description that should be read in light of the accompanying drawings.

DETAILED DESCRIPTION

Figure 1A:
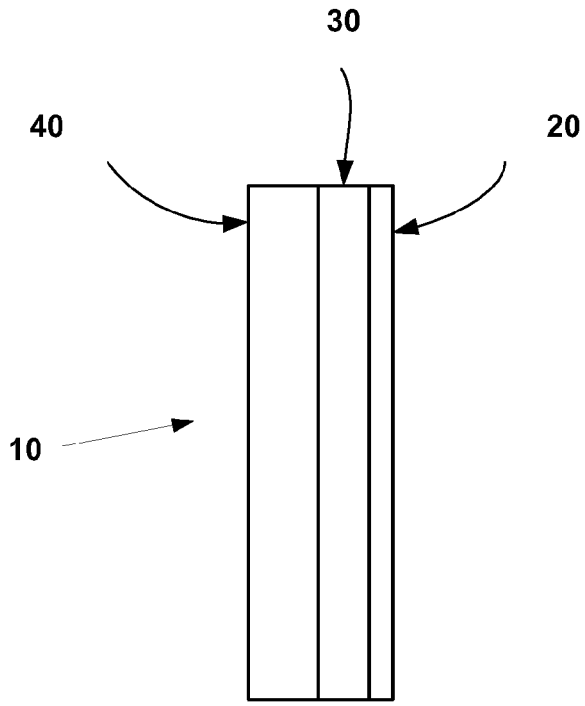
FIG. 1*a* is a side-view of a flat-film speaker with integrated polarization, mounted on a display screen, in accordance with an embodiment of the present invention.

A multifunctional display-transducer diaphragm is disclosed. In one particular embodiment, the diaphragm may be configured as a loudspeaker system for video displays. The multifunctional diaphragm may be transparent so that it may overlay the display, and may be made from materials that possess both the desired acoustical properties as well as desired polarization properties. Thus, a single diaphragm that exhibits both audio speaker capability and desired optical qualities such as polarization may be provided. Other optical properties, such as anti-reflective, anti-glare, wide-viewing angle, brightness enhancement, optical retardation as well as other properties such as EMI or IR filtering, anti-smudge, anti-static, etc. may also be integrated into the single multifunctional diaphragm. In alternative embodiments, further integration may be achieved, by integrating audio speaker capability and the desired optical and other properties listed above into the mechanical structure of the display screen itself.

In a conventional screen-speaker application, the display may be combined with an acoustic diaphragm that sits approximately 1 to 10 mm off the front of the outside viewing surface of the display. As explained in the previously incorporated U.S. Pat. Nos. 6,720,708 and 7,038,356, this diaphragm may perform the work of moving the air to produce sound. The mass, stiffness, internal damping characteristics and construction of this diaphragm all contribute to it's performance as an audio speaker. As part of the manufacturing process, these speaker diaphragms may further be coated or laminated with removable protective films to protect the diaphragm (e.g. during assembly, handling and/or shipping). The protective films may be removed at the installation site, for final assembly and deployment of the speaker diaphragm. Unfortunately, these protective films add considerable cost to the speaker diaphragm.

For a video display that utilizes polarized light (such as an LCD display), there typically may be at least one composite polarisation layer on or close to the outward facing surface of the display screen to polarize the light accordingly. This composite polarisation layer may generally be of multi-layer construction including one or several adhesive layers, a polarisation film, one or several cover films and optionally a retardation film or other optical layers or functional coatings. These composite polarisation layers may be further coated or laminated with removable protective films to protect the polarization film (e.g., during assembly, handling and/or shipping). The protective films may be removed at the installation site, for final assembly and deployment of the composite polarisation layer. Unfortunately, these protective films may add considerable cost to the composite polarisation layer.

The terms "polarize", "polarizer" or "polarization" refer to the capability of a layer or film to cause the electromagnetic light waves which pass through that layer or film to vibrate in a single plane. The process of transforming unpolarized light into polarized light is known as polarization. Polarization may occur due to transmission, reflection, refraction or scattering. The capability to polarize light may be related to the chemical composition of the material forming the layer or film, particularly with materials in which long-chain molecules may be aligned in the selected direction. Linear light polarizing films, in general, owe their properties of selectively passing radiation vibrating along a given electromagnetic radiation vector and absorbing electromagnetic vibration along a second given electromagnetic vector to the anisotropic character character of the transmitting film medium.

Polarizing films are normally prepared from a transparent and highly uniform, amorphous resin film that is subsequently stretched to orient the polymer molecules and then stained with a dye to produce dichroic film. An example of a suitable resin for the formation of polarizing films is fully hydrolyzed poly(vinyl alcohol) (PVA). Other resins that are contemplated for use herein include orientable polypropylene and polyesters. Because the stretched PVA films used to form polarizing films are very fragile and dimensionally unstable, protective cover films are normally laminated to both sides of the PVA film to offer both support and abrasion resistance. The polarizing film together with related cover films and optionally an adhesive layer are referred to as composite polarization layer.

In accordance with an embodiment of the present disclosure, the functionalities of an outside composite polarization layer and an audio diaphragm may be integrated into a single diaphragm. This diaphragm may sit approximately 1 to 10 mm off the front of the outside viewing surface of the video display, as described in the previously incorporated U.S. Pat. Nos. 6,720,708 and 7,038,356. One benefit of this integration may be the reduction in combined thickness of display screen and diaphragm, an improvement in optical characteristics, as well as an improvement in audio performance.

When integrating a composite polarization layer into a speaker diaphragm and maintaining the same or similar acoustic performance of the comparable separate composite polarization layer and diaphragm the thickness of the diaphragm is now maintained at approximately the same of what it would have been for the case of separate diaphragm and composite polarization layer. Hence, the combined thickness of a given display screen and speaker diaphragm may now be reduced. This may now be particularly the case in an LCD display screen, which typically has a front and back composite polarization layer, which may now no longer require the front composite polarization layer.

For LCD display applications the thickness of the composite polarization layer (including a related pressure sensitive adhesive layer, a polarizing film layer and two protective cover film layers such as cellulose triacetate) typically ranges from 0.08 mm to 0.25 mm. For comparison, the complete display panel for mobile phones and other portable applications can be as thin as 0.74 mm, display panels for notebooks can be as thin as 3.0 mm and even for large size TVs of 42" diagonal displays panels with thickness of 10.5 mm are available. Manufacturers for display panels are competing vigorously on the reduced thickness of their panels and they are investing very significant resources into making their panels thinner. Hence a thickness reduction of typically 0.08 mm to 0.25 mm is a significant improvement.

The audio performance of the single diaphragm construction disclosed herein may be improved because the unitary construction may allow an optimal selection of materials for a given cost position. The selection of the various layer materials of the polarizing aspect of the diaphragm (such as types of optically clear materials, types of polarizing materials, adhesive if any, etc) may be chosen to allow for improved acoustic performance due to achieving a desired combination of mass, stiffness and internal damping. In addition, because of the distance from the display screen, the polarizing aspect of the diaphragm may be optimized for that particular spacing and result in improved optical characteristics of the multifunctional diaphragm with integrated acoustical and optical properties.

One example is the improved total luminous transmittance (measured according to ASTM D1003-07e1) of a diaphragm with an integrated polarizing film relative to an implementation with a separate composite polarization layer. This is due to the fact that for the case of a diaphragm with integrated polarizing film the total thickness of optical film material through which the display image passes before it is seen by the viewer is reduced. As most optical films absorb a fraction of the light that passes through them a reduction in overall thickness will increase the total luminous transmittance. Another example for improved optical performance is contrast enhancement and glare reduction by suppressing internal reflections from external ambient light. This may now be achieved by integrating a polarizing layer in combination with a quarter wave retarder film into the diaphragm without removing the original composite polarization layer from the display screen. A retarder film may be understood as a material that turns the polarized light at an angle (for example 45 degrees).

Another benefit of this integration may be a reduction in cost for the combination. This cost savings may not be trivial, nor is it obvious, as conventional coatings and display constructions are generally thought to be highly manufacturable and relatively efficient. Thus, motivation to modify such long-standing conventional processing and constructions is lacking. Cost savings can be achieved, for example: by combining two or more separate diaphragms and/or surface enhancements (e.g., antiglare, anti-reflection or other) into single multifunctional diaphragm; by reducing the number and cost of protective films required for conventional separate constructions; by removing the need for, or otherwise reducing the number of, adhesion layers; and by reducing the amount of coating and/or diaphragm materials required for the polarizing and speaker functions.

However, the integrated construction as described herein is one that may be capable of achieving a set target for stiffness, thickness and damping of the speaker diaphragm as well as achieving the required polarization function (and any other desired optical and other functions).

Multifunctional Diaphragm

Figure 1B:
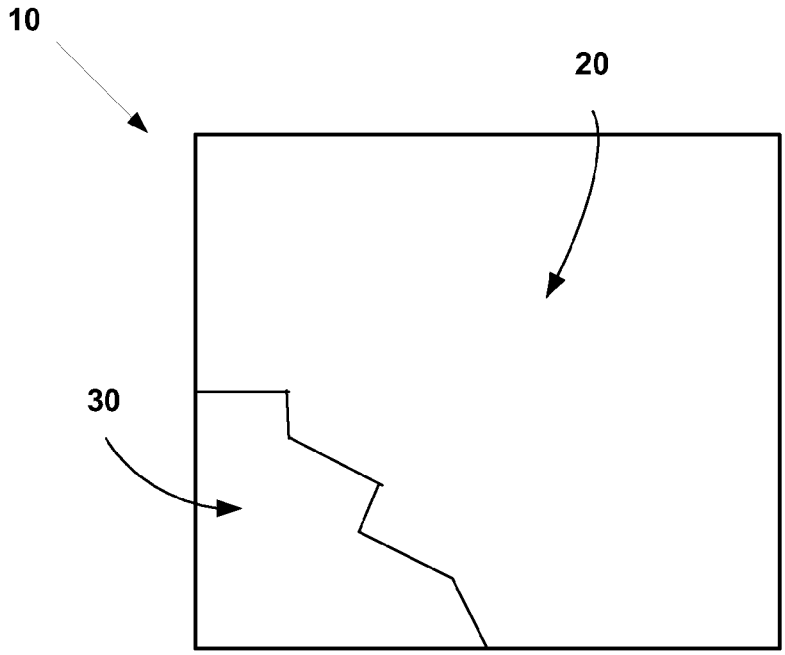
FIG. 1*b* is a cutaway front-view of the flat-film speaker shown in FIG. 1*a*.

FIGS. 1*a* and 1*b* illustrate in side view and cut-away front view, respectively, a video display system including an acoustic system 10 comprising a flat-film speaker with integrated polarization 20 mounted on a display screen 30, in accordance with an embodiment of the present disclosure. The use of a polarizing film layer with the flat-film speaker diaphragm is discussed more fully below. As can be seen in this initial general illustration, the display screen 30 may be operatively coupled with an electronics and backing (housing) assembly 40. In addition, the flat-film speaker with integrated polarization 20 may be mounted on the display screen 30 (e.g., leaving a spacing between the diaphragm and the display screen 30). For instance, when the speaker is used over an LCD display screen, the screen-to-diaphragm spacing is typically in the range of 1 mm to 10 mm. The flat-film speaker 20 containing light polarizing functionality may essentially be a multifunctional diaphragm, and may be implemented, for example, as a thin, flexible sheet formed in a curvature of a parabolic section, such as the sheet described in the previously incorporated U.S. Pat. Nos. 6,720,708 and 7,038,356. The multifunctional diaphragm may be any transparent, relatively high Young's Modulus material having the capability to polarize light.

A relatively high Young's Modulus may be in the range of about 1 GPa to 80 GPa. There is no limit for the thickness of the multi-functional diaphragm as this may vary amongst other things with the diaphragm outer dimensions, the design intent and the intended use of a specific audio transducer and the diaphragm materials chosen. However, in a preferred embodiment the thickness of the multifunctional diaphragm is in the range from 100 μm to 2 mm, including all values therein, in 10 μm increments. For example, one preferred range is 100 μm to 1 mm. Particular examples of such polarizing materials include transparent polarizing glass and polarizing plastic. One specific example is a polarizing laminate containing polyvinyl alcohol (PVA) preferably in film form positioned between two optically clear substrates (e.g. cellulose triacetate) having suitable stiffness/flexibility to allow for the acoustic transducer functionality, as will be apparent in light of this disclosure. The multifunctional diaphragm may further be operatively coupled to one or more actuators as also described in the previously incorporated U.S. Pat. Nos. 6,720,708 and 7,038,356.

Figure 2:
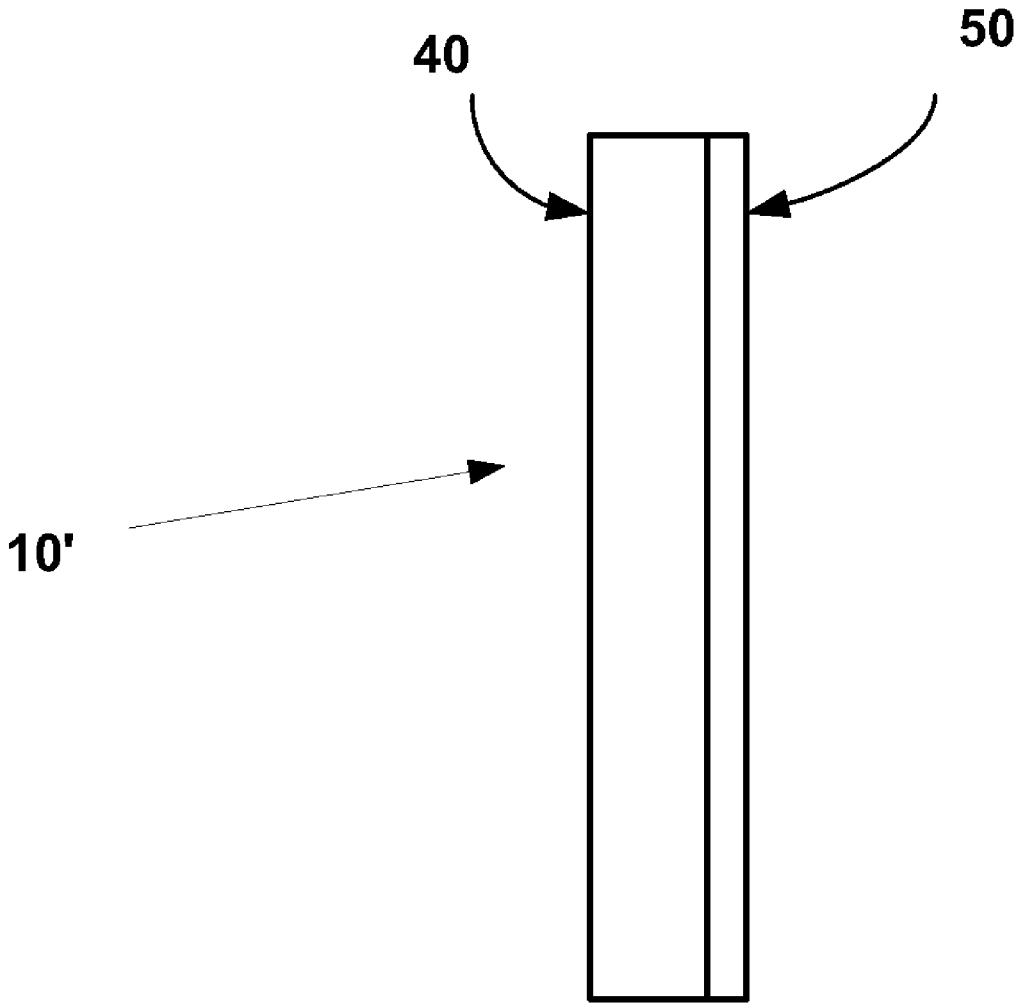
FIG. 2 is a side-view of a display system configured with a display screen having an integrated flat film speaker, in accordance with an embodiment of the present invention.

FIG. 2 is a side-view of a display system 10' configured with a display screen having an integrated flat-film audio speaker 50 again containing polarizing capability, in accordance with an embodiment of the present disclosure. In this exemplary embodiment, the display screen itself may be made from a material that allows polarization in combination with audio speaker function, and may be operatively coupled to the display electronics and backing assembly (e.g., housing) 40. The multifunctional screen 50 may comprise a diaphragm, that can be made, for example, of any transparent or optical quality materials such as poly(ethylene terephtalate) (PET), polymethyl-methylacrylate (PMMA, e.g., acrylic), Kapton® (poly amide-imide), polycarbonate, polyvinylidene fluoride (PVDF), polypropylene, or related polymer blends; or tri-acetates, such as cellulose triacetate, cycloolefine copolymer (COP), poly-4-methyl-1-pentene and glass. Such materials not only allow for typical display screen qualities and attributes, but also may be used as an acoustic transducer as described in the previously incorporated U.S. Pat. Nos. 6,720,708 and 7,038,356. In addition, the display screen may include a backing layer or substrate (not shown) suitable for the given screen type, such as an liquid crystal display (LCD). In addition, details of the incorporation of a layer of polarization film material is discussed more fully below.

Figure 3:
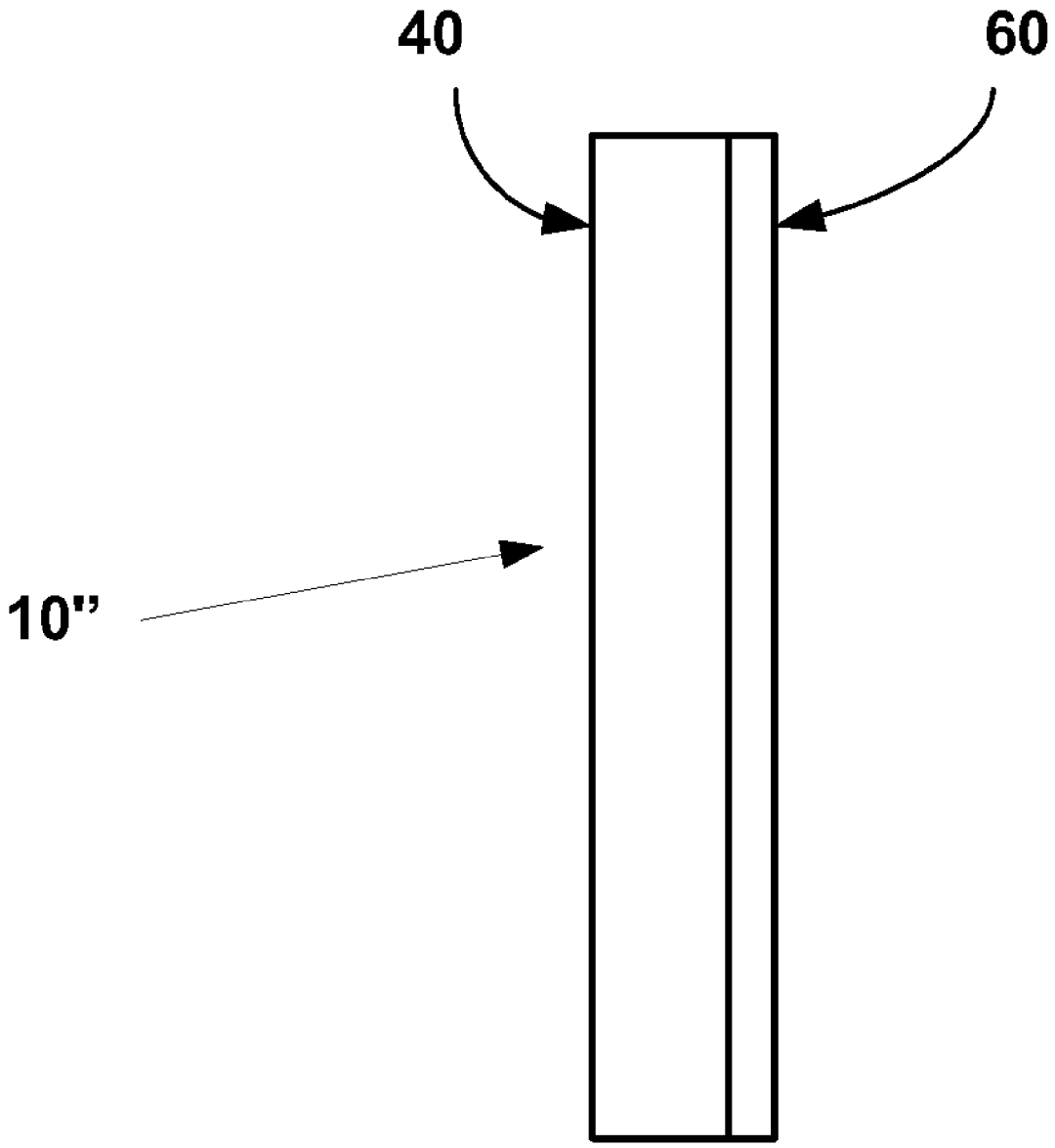
FIG. 3 is a side-view of a display system configured with a display screen having an integrated flat film speaker with integrated polarization, in accordance with another embodiment of the present invention.
Figure 4:
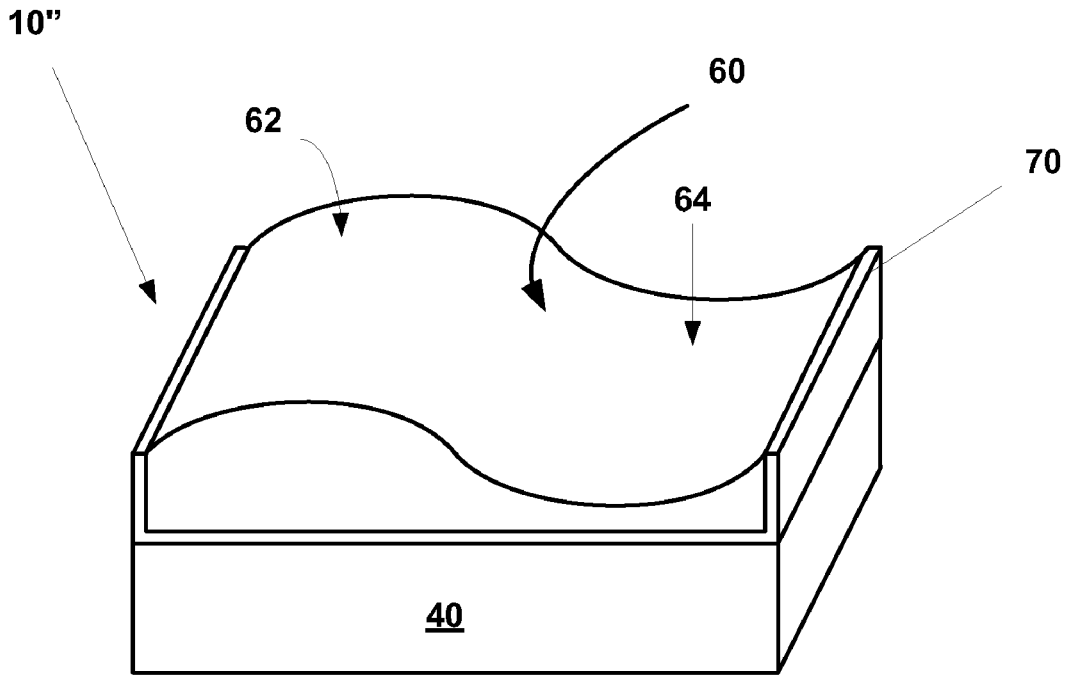
FIG. 4 is a perspective-view of a display system configured with a display screen having an integrated flat film speaker and polarization of FIG. 3.

FIGS. 3 and 4 illustrate in side view and perspective view, respectively, a display system 10" configured with a display screen including an integrated speaker diaphragm with polarization capability 60, in accordance with an embodiment of the present invention. Again, the details of the diaphragm and the use of a polarizing layer of film material in the diaphragm is discussed in more detail below. In this exemplary embodiment, the display screen 60 may be operatively coupled to the display electronics and backing assembly (e.g., housing) 40, and may be made from a material that allows integration of both the flat-film audio speaker function as well as the capability of polarization. The screen 60 may be made, for example, of materials similar to those discussed with reference to FIGS. 1*a* and 1*b* (e.g., transparent polarizing glass or polarizing plastic, such as poly(vinyl alcohol) plastic sheet or film). Such materials not only allow for desired display screen qualities including the capability of polarization, but also may be used as an flat-film acoustic transducer as described in the previously incorporated U.S. Pat. Nos. 6,720,708 and 7,038,356. In addition, the screen 60 may include a backing layer or substrate (not shown) suitable for the given screen type, such as an LCD, OLED, or flat panel screen.

As illustrated in FIG. 4, the display screen 60 may include a curved section 62 which is at least partially convex in shape and/or include a section 64 which is at least partially concave in shape to create "wings", whereby, if both are present, creating left and right speaker sections. The curvature may preferably be that of a parabola (viewed in a plane orthogonal to a vertical axis, e.g., the pinned centerline). As shown, the display screen may further comprise an integrated flat film speaker with polarization capability 60 operatively coupled to a relatively high efficiency, relatively short linear travel piezo actuator 70. By relatively short linear travel, it is meant a typical maximum piezo tip displacement from the neutral position in the range of about 0.005 mm-0.2 mm.

The diaphragm that may be used herein, in combination with a polarizing film, may also include the diaphragms that are disclosed in U.S. patent application Ser. No. 12/399,810, filed Mar. 6, 2009, whose teachings are also incorporated herein by reference in their entirety. As disclosed therein, the diaphragm may comprise (a) a layer of optically clear film; (b) a damping layer; (c) a layer of optically clear film; wherein the diaphragm has a composite damping value of tan delta equal to or greater than 0.04 in the frequency range of 500 Hz to 2000 Hz at 30° C., wherein the diaphragm has a total luminous transmittance of equal to or greater than 75%. In another embodiment, the diaphragm may comprise (a) a layer of optically clear film; (b) a damping layer; (c) a layer of optically clear film; wherein the damping layer has a damping value of tan delta that is equal to or greater than 0.1 at said frequency range from 500 Hz to 2000 Hz at 30° C. In another embodiment, the diaphragm may comprise at least two optically clear films, wherein the films indicate a coefficient of linear thermal expansion (CLTE) in one of the machine direction and transverse direction equal to or below 50 μm/m/° C. when measured at the temperature range of 20° C. to 50° C. and wherein the total luminous transmittance of said diaphragm is equal to or greater than 75%.

In a preferred implementation a multifunction diaphragm is constructed that contains at least one transparent film, at least one damping layer and at least one film that is a light polarizing film. The light polarizing film may also have the function of damping layer at the same time, eliminating the need for a separate damping layer. The light polarizing film is characterized by exhibiting a crossed transmittance of less than 20%, more preferrably less than 10% and even more preferrably less than 5%. Crossed transmittance refers to the value of total luminous transmittance (measured as per ASTM D1003-07e1) for crossed polarizing films (two polarizing films of the same type and size, where the axis of polarization for each polarizing film is separated by a 90 degree angle).

The polarizing film may consist of just a layer of polarizing material or it may be a laminate of multiple films such as a polarizing material with layers of protective cover film on one or both sides and/or a polarizing material in conjunction with one or several retarder films. The polarization orientation of the film may be matched with the orientation of the light emitted from the underlying display screen in order to provide for maximum light transmittance and/or for optimum image quality. However, it should be noted that the total luminous transmittance of the polarizing film is lower than for the optically clear film due to its polarizing nature.

In one preferred implementation the total luminous transmittance of the polarizing film as well as the diaphragm itself with its various layers is greater than or equal to 35%, and in the range of 35% to 50%. One example of an implementation is the use of a 250 um PET film such as DuPont-Teijin Melinex ST730 (available from DuPont Teijin Films U.S, Hopewell, Va.) and a 215 um composite polarisation layer with adhesive such as NPF-SEG1224DU (available from Nitto Denko, Tokyo, Japan). The composite polarisation layer includes a pressure sensitive adhesive (PSA) of 25 μm. When assembled as a transducer and used with a display screen the diaphragm is oriented in such a way that the PET film is facing to the outside (towards the viewer) and the composite polarizing layer is facing towards the video display. In this embodiment, the PSA layer of the composite polarizing layer represents the damping layer.

Figure 5A:
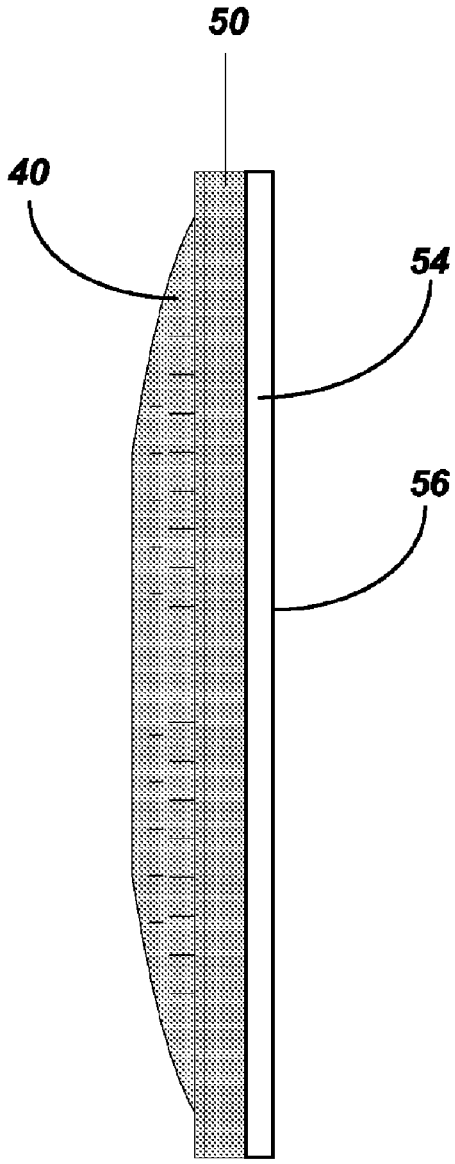
FIG. 5A is a cross-sectional view of a display screen including the multifunction membrane herein.
Figure 5B:
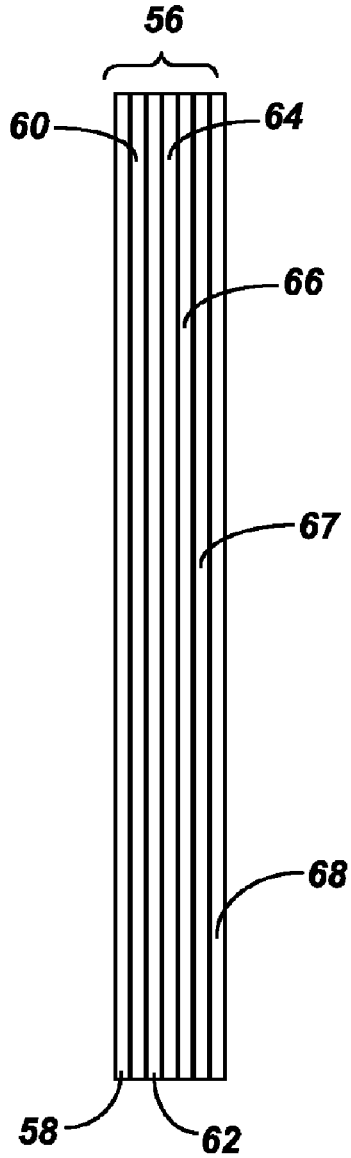
FIG. 5B is a cross-sectional view of one configuration for the multifunctional polarizing membrane disclosed herein.

FIG. 5A illustrates in cross-section such a preferred configuration. As can be seen, one may have a backhousing 40 containing the electronics, a display screen 50, an air gap 54, and the diaphragm 56. An enlarged cross-sectional view of diaphragm 56 is shown in FIG. 5B consisting of the following layers: optical coating layer 58, protective cover layer (cellulose triacetate) 60, polarizing film layer (PVA) 62, protective cover layer (cellulose triacetate) 64, pressure sensitive adhesive layer 66, PET layer 67 and optical coating layer 68. Although the layers are illustrated to have the same general thickness, it may be appreciated that the thickness of each of the layers may be adjusted as desired. For example, the optical coating layers may have a thickness of 0.1 μm to 10 μm, the polarizing film layer may have a thickness of 3 μm to 75 μm or more preferrably 5 μm to 50 μm, the cellulose triacetate layers may have a thickness of 40 μm to 250 μm, more preferably 50 μm to 80 μm, the pressure sensitive adhesive layer may have a thickness of 5.0 μm to 50 μm and the PET layer may have a thickness of 30 μm to 400 μm. One benefit of this preferred implementation is that it can be readily manufactured with widely available components (composite polarization layer and PET film) and processes (for example roll-to-roll lamination or sheet lamination) without expensive and time-consuming custom development steps.

Figure 6:
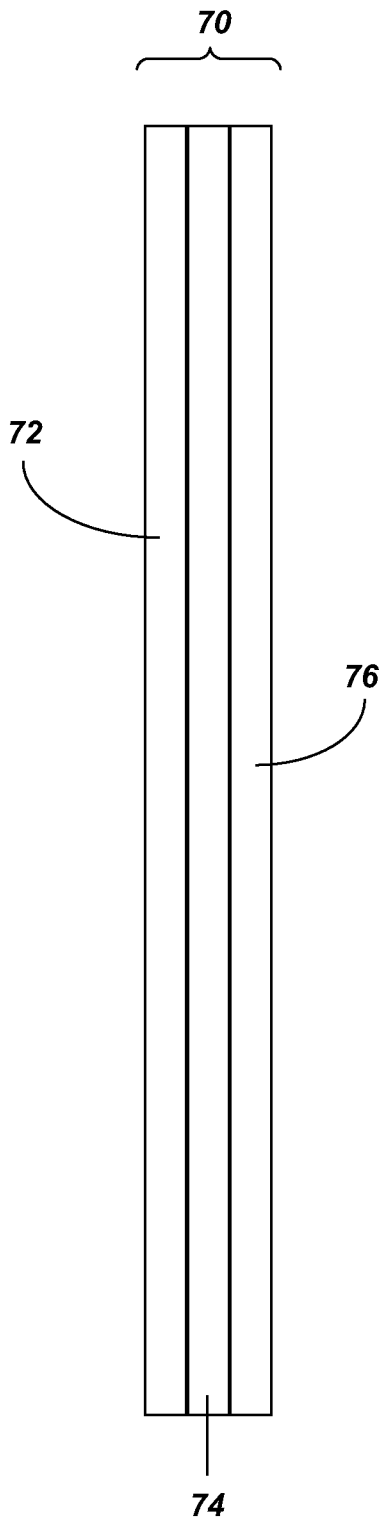
FIG. 6 is another cross-sectional view of another configuration of the multifunctional polarizing membrane that is disclosed herein.

In a contemplated implementation of the multifunction membrane the number of films comprising the membrane may be reduced relative to the preferred implementation by utilizing only one polarizing film layer inbetween of two protective cover layers. This 3-layer configuration is illustrated at 70 in FIG. 6 wherein layer 72 is a protective cover layer, layer 74 is the polarizing film layer along with protective cover layer 76. Preferrably the two protective cover layers are made up of a relatively stiff and relatively lightweight polymeric material such as cellulose triacetate (TAC), polycarbonate (PC), cycloolefin copolymer COP, poly(ethylene terephthalate) PET, poly(ethylene napthalate) PEN, poly(methyl methacrylate), polyimide (e.g. KAPTON™), poly(vinylidine fluoride), poly(amide-imide), polypropylene, poly-4-methyl-1-pentene (TPX) or of tempered glass. The two protective cover layers can be made from the same material or from different materials. Preferrably, the inside layer (facing the display screen) is made of a material type and grade that has a uniform thickness, a low retardation which is expressed by a product of birefringence and thickness, a small retardation unevenness, and a low moisture absorption. If the in-plane retardation is large, the retardation unevenness is high or the thickness unevenness is high, the image quality of liquid crystal displays is considerably deteriorated. Namely, the color irregularity phenomenon in which displayed colors are partially faded and the deflection of images occurs. The in-plane retardation of the protective cover layer at a wavelength of 550 nm is preferably 20 nm or less, more preferably 15 nm or less, still more preferably 10 nm or less and still further preferably 5 nm or less. Materials that are available and commonly used in grades that exhibit this low in-plane retardation are TAC and COP, however other materials with low in-plane retardation are available or under development as well, particularly PC and PET. This contemplated implementation might again be enhanced by additional layers of optical coatings or other functional layers as mentioned before.

Reference herein to the characteristics of being "optically clear" may be understood as reference to either a desired haze and/or total luminous transmittance property for layer or layers at issue. That is, in order for the image of the video display to be visible the diaphragm may be configured to possess a preferable haze and total luminous transmittance characteristic. Such properties may be considered with respect to the particular layers at issue as well as for the overall diaphragm. For example, the diaphragm may utilize optically clear film each having haze values (measured according to ASTM D1003-07e1) of less than or equal to 30%, more preferably less than or equal to 20%. In the case where no antiglare treatment of the diaphragm is desired the haze value is preferably at or below 4%, more preferably at or below 3% and most preferably at or below 2%. The total luminous transmittance properties of the optically clear layer or layers, other than the polarizing film layer may be at or above 75% (measured according to ASTM D1003-07e1). All values refer to the properties as measured during or immediately after production. That is, the properties are best measured under those circumstances where they are not subject to environmental changes (e.g. relatively long term exposure to elevated temperatures) that would alter the referenced haze values and/or luminous transmittance properties.

As noted above, the polarizing film layer is such that its total luminous transmittance is greater than or equal to 35% and preferably in the range of 35% to 50%. Accordingly, as the diaphragm herein includes a polarizing film layer, the total luminous transmittance of the diaphragm containing the polarizing film layer may similarly be greater than or equal to 35%. Such a diaphragm may therefore still be transparent for use to overlie a video display or other type of display screen.

"Operatively coupled" as used herein refer to any connection, coupling, link or the like by which the operations of one system element are imparted to the "coupled" element. Such "operatively coupled" devices are not necessarily directly connected to one another and may be separated by intermediate components or devices. Likewise, the terms "connected" or "coupled" as used herein in regard to physical connections or couplings is a relative term and does not require a direct physical connection.

It should be noted that some displays may not need polarization, but embodiments of the present invention may still provide the benefits of a multifunctional diaphragm. For instance, flat film speakers as described herein may be used in conjunction with a display that is utilizing polarized light, such as an LCD display; alternatively, embodiments may be used with other displays such as OLED and plasma displays which don't necessarily require polarizing films. In such alternative cases, a polarizing function may still provide benefit, such as a privacy filter or screen. In addition, a multifunctional speaker screen as described herein may include some type of further integrated optical properties, or even various coatings for enhancing optical performance, such as anti-reflective, anti-glare, wide-viewing angle, hard-coat, and brightness enhancement, or other types of desired optical qualities.

While the principles of the disclosure have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A diaphragm for use with a mechanical-to-acoustical transducer, comprising:

a. a layer of optically clear film having a haze value of less than or equal to 30% and a total luminous transmittance of equal to or greater than 75%;

b. a layer of polarizing film capable of polarizing light therethrough exhibiting a crossed transmittance of less than 20%;

wherein the diaphragm is capable of converting mechanical motion into acoustical energy, wherein said diaphragm has a thickness of 100 microns to 2.0 mm, a Young's Modulus in the range of 1 GPa to 80 GPa, and said polarizing film has a total luminous transmittance of greater than or equal to 35%.

2. The diaphragm of claim 1 wherein the total luminous transmittance of said polarizing film is in the range of 35% to 50%.

3. The diaphragm of claim 1 wherein the diaphragm has a total luminous transmittance of at least 35%.

4. The diaphragm of claim 1 wherein the polarizing film is positioned between at least two optically clear films.

5. The diaphragm of claim 1 wherein the polarizing film comprises polyvinyl alcohol (PVA).

6. The diaphragm of claim 1 wherein the optically clear film comprises cellulose acetate, polycarbonate, cyclo-olefin copolymer, poly(ethylene terephthalate), poly(ethylene naphthalate), polyimide, poly(vinylidine fluoride), poly (amide-imide), polypropylene, poly-4-methyl-1-pentene, or tempered glass.

7. The diaphragm of claim 1 wherein at least one of said optically clear films has an in-plane retardation at a wavelength of 550 nm of less than or equal to 20 nm.

8. The diaphragm of claim 1 wherein said diaphragm has a composite damping value of tan delta equal to or greater than 0.04 in the frequency range of 500 Hz to 2000 Hz at 30° C.

9. The diaphragm of claim 1 wherein said polarizing layer acts as a damping layer and has a damping value of tan delta that is equal to or greater than 0.1 in the frequency range from 500 Hz to 2000 Hz at 30° C.

10. The diaphragm of claim 1 wherein said polarizing film has a thickness of 3 μm to 75 μm.

11. The diaphragm of claim 1 wherein said optically clear film has a thickness of 40 μm to 400 μm.

12. An acoustic transducer that converts a mechanical motion into acoustical energy, said acoustic transducer comprising a. a diaphragm comprising a layer of optically clear film having a haze value of less than or equal to 30% and a total luminous transmittance of equal to or greater than 75%;

b. a layer of polarizing film capable of polarizing light therethrough and characterized by exhibiting a crossed transmittance of less than 20% and is capable of converting mechanical energy into acoustical energy wherein said diaphragm has a thickness of 100 microns to 2.0 mm, a Young's Modulus in the range of 1 GPa to 80 GPa and said polarizing film has a total luminous transmittance of greater than or equal to 35%.

13. The transducer of claim 12 wherein the total luminous transmittance of said polarizing film is in the range of 35% to 50%.

14. The transducer of claim 12 wherein the polarizing film is positioned between at least two optically clear films.

15. The transducer of claim 12 wherein the polarizing film comprises polyvinyl alcohol (PVA).

16. The transducer of claim 12 wherein the optically clear film comprises cellulose acetate, polycarbonate, cyclo-olefin copolymer, poly(ethylene terephthalate), poly(ethylene naphthalate), polyimide, poly(vinylidine fluoride), poly (amide-imide), polypropylene, poly-4-methyl-1-pentene, or tempered glass.

17. The transducer of claim 12 wherein at least one of said optically clear films has an in-plane retardation at a wavelength of 550 nm of less than or equal to 20 nm.

18. The transducer of claim 12 wherein said diaphragm has a composite damping value of tan delta equal to or greater than 0.04 in the frequency range of 500 Hz to 2000 Hz at 30° C.

19. The transducer of claim 12 wherein said polarizing layer acts as a damping layer and has a damping value of tan delta that is equal to or greater than 0.1 in the frequency range from 500 Hz to 2000 Hz at 30° C.

20. The transducer of claim 12 wherein said polarizing film has a thickness of 3 μm to 75 μm.

21. The transducer of claim 12 wherein said optically clear film has a thickness of 40 μm to 400 μm.

* * * * *